US011499252B2

(12) United States Patent
Ramsauer

(10) Patent No.: US 11,499,252 B2
(45) Date of Patent: Nov. 15, 2022

(54) ADJUSTABLE MULTIPLE YARN CRAFTING FINGER AIDE GUIDE RING FOR CROCHETING OR KNITTING

(71) Applicant: Patricia Blanca Hilda Ramsauer, Leland, NC (US)

(72) Inventor: Patricia Blanca Hilda Ramsauer, Leland, NC (US)

( * ) Notice: Subject to any disclaimer, the term of this patent is extended or adjusted under 35 U.S.C. 154(b) by 0 days.

(21) Appl. No.: 17/119,119

(22) Filed: Dec. 11, 2020

(65) Prior Publication Data

US 2022/0186411 A1 Jun. 16, 2022

(51) Int. Cl.
*D04B 3/04* (2006.01)

(52) U.S. Cl.
CPC ..... *D04B 3/04* (2013.01)

(58) Field of Classification Search
CPC ... D04B 3/00; D04B 3/02; D04B 3/04; D04B 3/06
USPC ..... 66/1 A
See application file for complete search history.

(56) References Cited

U.S. PATENT DOCUMENTS 370,893 A * 10/1887 Royce ..... 242/153
1,208,085 A * 12/1916 Branley ..... 242/153
1,243,162 A * 10/1917 Gruman ..... 242/149
1,282,953 A * 10/1918 Sauer ..... 242/157 R
D59,449 S * 10/1921 Abate et al. ..... D3/18
2,133,221 A * 10/1938 White ..... D04B 3/00 242/157 R
2,142,608 A * 1/1939 Hockert ..... D04B 3/00 242/149
2,244,903 A * 6/1941 Walk ..... D04B 3/00 242/153
2,434,609 A * 1/1948 Coffey ..... D04B 3/00 242/150 R
2,472,702 A * 6/1949 Greenstein ..... D04B 3/00 242/149
2,513,851 A * 7/1950 Dodds ..... A41H 31/00 24/3.1
2,524,157 A * 10/1950 Beirer ..... D04B 3/00 66/125 R
4,037,433 A * 7/1977 Weber ..... D04B 3/04 66/1 A
4,370,870 A * 2/1983 Kroh ..... D04B 3/00 66/1 A
4,713,947 A * 12/1987 Collins ..... D04B 33/00 242/147 R
4,991,410 A * 2/1991 Donatelli ..... D04B 3/04 223/106
D326,241 S * 5/1992 Kroh ..... 63/1.12
5,125,245 A * 6/1992 Kuwabara ..... D04B 3/04 16/225
11,060,217 B2 * 7/2021 Rees ..... D04B 3/04

FOREIGN PATENT DOCUMENTS

CH 195301 A * 1/1938 ..... D04B 3/04
DE 3705513 A1 * 9/1988 ..... D04B 3/04

* cited by examiner

*Primary Examiner* — Danny Worrell

(57) ABSTRACT

An apparatus with open loop yarns separator guides on each side of a main body. This body having an ergonomic shape and supported by a ring shape mount to fit on a finger.

2 Claims, 1 Drawing Sheet

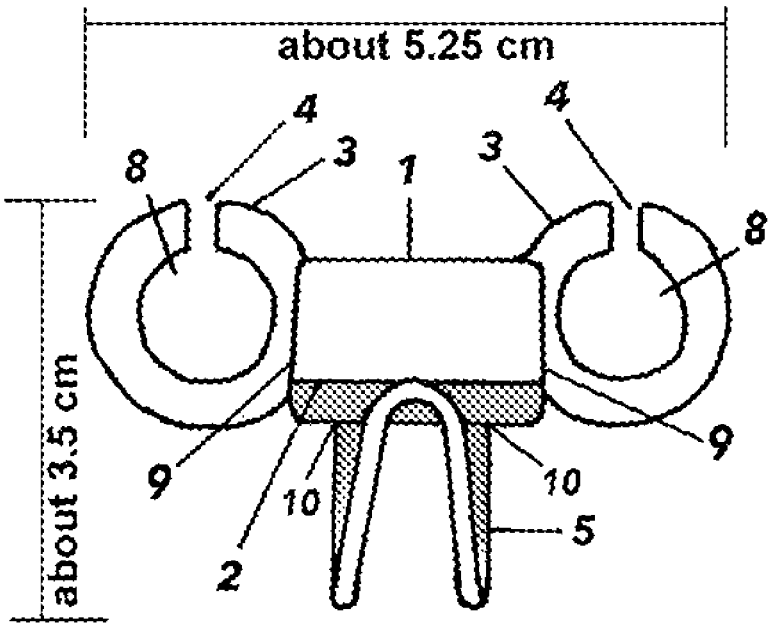

FIG.1) BACK VIEW

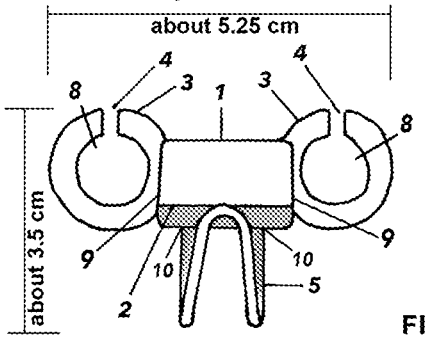

FIG.2) FRONT VIEW

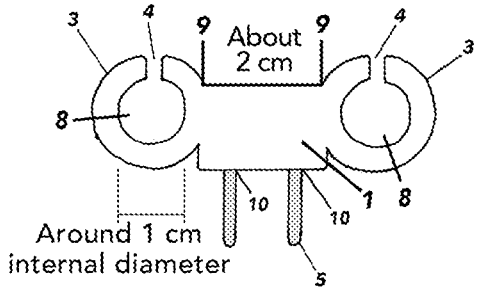

FIG.3) SIDE VIEW

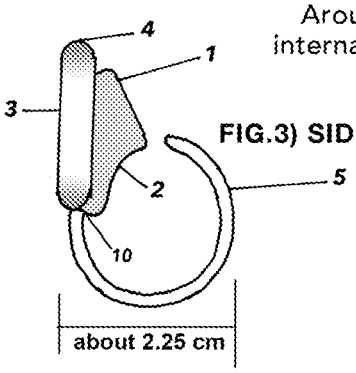

FIG.7) ISOMETRIC VIEW

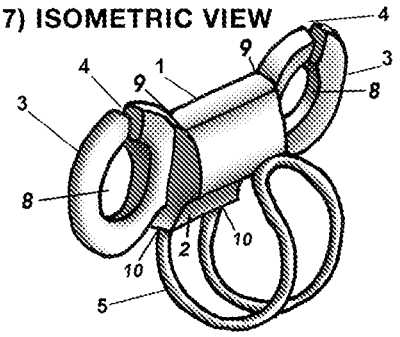

FIG.6) TOP VIEW

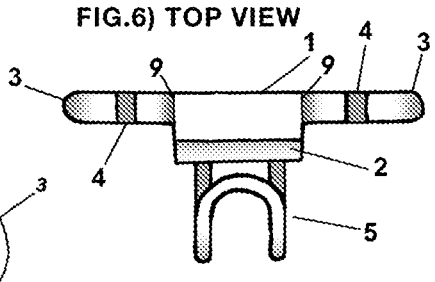

FIG.5) BOTTOM VIEW

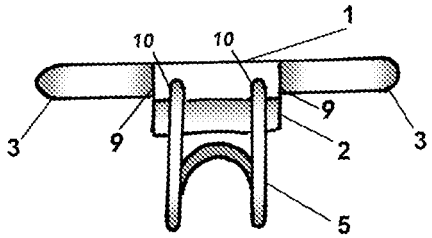

FIG.4) USE OF THE INVENTION

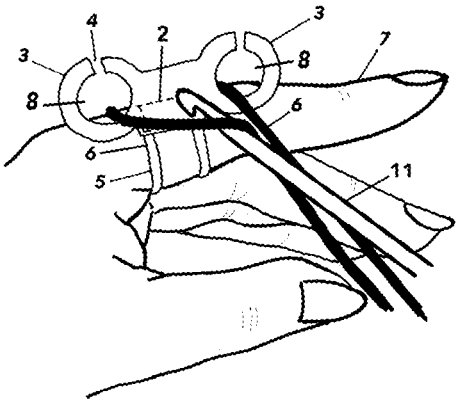

Elements of the device:

1. Main body
2. Ergonomic concave curved shape
3. Open loop yarns separator guides
4. Loop opening
5. U-shaped wire curled into an adjustable ring shape mount.
6. Yarns
7. Index finger
8. Internal diameter
9. Ends of main body
10. Holes on the bottom of the main body
11. Crochet tool

ADJUSTABLE MULTIPLE YARN CRAFTING FINGER AIDE GUIDE RING FOR CROCHETING OR KNITTING

BACKGROUND

Field of the Invention

The invention generally relates to yarn separation for crocheting and knitting multi strand projects.

Background

Color-work knitting or crocheting projects present problems on reaching different yarn colors with the need to drop each yarn to change to another color, losing time and the yarns get tangled as part of the fabric creation. Some attempted solutions have been the Yarn Stranding Guide and the Wire Stranding Guide ring, that is on the market, but this has not sufficiently addressed the needs of the users owing to its awkwardness and inefficiency.

SUMMARY

A main body with an ergonomic shape, a plurality of open loop yarns separator guides, with an opening on the upper side to allow insertion or removal of one or multiple yarns and an adjustable ring mount to fit on a finger.

BRIEF DESCRIPTION OF THE DRAWINGS

An exemplary embodiment of the present invention is illustrated by way of example in the accompanying drawings in which like reference numbers indicate the same or similar elements and in which:

FIG. 1) BACK VIEW Shows two open loop yarns separator guides (3) positioned parallel lengthwise to each other and to the main body (1). Each loop (3) on each side (9) of the main body (1), two loops (3) being the preferred embodiment as the main function of the device is to be a yarns separator (may be two, three or more loops). Each open loop yarns separator guide (3) shows an internal diameter (8) (around 1 cm internal diameter), being this part a novel shape size of the present invention—where this size makes it easy to work with multiple yarns and provide smooth flow. Each loop (3) with an upper opening (4)—around 2 mm—is wide enough to allow easy placement or exchange of yarns and small enough to keep the yarns in place. This side of the main body (1) has an ergonomic concave curved shape in the lower portion (2)—being the ergonomic concave curved shape part of the novelty of the present invention—which sits comfortably on the side of the preferably proximal phalanx of the index finger. This view shows the U-shape wire curled into an adjustable ring shape mount (5), inserted on the holes made on the bottom (10) of the main body (1)—being this adjustable shape part of the novelty. The overall width of the device from the outside of one loop (3) to the outside of the other loop (3) is about 5.25 cm and the height of the device measured from the bottom of the device wire (5) to the top of the device loops (3) is about 3.5 cm.

FIG. 2) FRONT VIEW shows the flat side of the device which faces the work space. The separation—about 2 cm—between the open loop yarns separator guides (3) given by the top elongated area of the main body (1), between the ends of the main body (9)—being this generous wide space between loops (3) part of the novelty of the actual invention—provides enough separation between yarns, so they can be reached by the crafter's crochet or knitting needle individually. In this view we can appreciate the generous size of the open loop internal diameter (8) of around 1 cm, which allows multiple yarns in each loop and smooth flow. This image shows two open loop yarns separator guides (3) as the preferred embodiment.

FIG. 3) SIDE VIEW shows the ergonomic concave curved shape (2) formed integrally with the main body (1)—being this specific ergonomic shape part of the novelty of the present invention-, and the open loop yarns separator guides (3) as one piece altogether. This view shows clearly how the U-shaped wire is actually curled into an adjustable ring shape mount (5)—being this specific ring shape open on the top, part of the novel shape of the present invention-. The depth of the device is about 2.25 cm from the facing side of the main body (3) to the longest distance of the outer portion of the wire ring (5). Only one side view is shown because it looks the same from both sides.

FIG. 4) USE OF THE INVENTION, shows how the device is adjusted to the proximal phalanx area of the preferred index finger (7) with the adjustable U-shaped wire curled into an adjustable ring shaped mount (5) which helped by the ergonomic concave curved shape positions the device sitting upright high enough on the finger (7) allowing the yarns (6) to flow smoothly through the yarn open loop yarns separator guides (3), the yarns flowing parallel to each other. An intermittent line shows the ergonomic concave curved shape (2), supporting the ring comfortably on the proximal phalanx of the preferred index finger (7). A yarn (6) is placed into each open loop yarns separator guide (3) easily through the upper opening (4)—which is a novelty of the present invention in the fact that it is easy to insert and exchange yarns without wasting time-. Then the yarn's tension is acquired preferably by interlacing the yarn between the other three fingers that are behind the device (not shown). This view gives and idea of the distance between the two loops (about 2 cm), which is of crucial importance, given by the main body (1). This view shows the crochet (11) movement in order to efficiently reach each yarn separately. The size of the each open loop yarns separator guide (3) (around 1 cm internal diameter), being this two ample measurements some of the most important novelties of the present invention.

FIG. 5) BOTTOM VIEW shows the point of attachment of the U-shaped wire curled into an adjustable ring shape mount (5) to the main body (1), which is a U-shaped wire inserted and fixedly secured in two holes that were already made on the bottom (10) of the main body (1) then the U-shaped wire is curled into a ring shape, with the opening to adjust the ring size on top of the ring shape wire.

FIG. 6) TOP VIEW, shows the top openings (4) of the open loop yarns separator guides (3). The main body (1) being the separation between loop yarn guides (3) one loop on each end (9) of the main body (1) and the ergonomic curved concave shape (2) extension on the main body's lower portion.

FIG. 7) ISOMETRIC VIEW is a diagrammatic representation of the exemplary widget within the present invention may be deployed: it shows the view of the device where we can appreciate the whole dimension of preferred embodiment of this invention, showing the back view with the concave curved ergonomic shape (2), —being this an important part of the novelty of this invention—, and how it would adjust to a finger with the help of the adjustable ring shape mount (5) that is preferably an enameled copper wire. Here we get an idea on how distant are the open loop yarns separator guides (3) from each other (about 2 cm), being this generous distance given by the main body a very important part of the novelty of this present invention because this space between guides works as a convenient yarn separator for color-work projects. The ample size of each open loop yarns separator guide (3) inner wall portion (around 1 cm internal diameter) (8) is also a very important part of the novelty of this invention because this size allows the placement and smooth flow of multiple strands of yarn in each open loop guide (3).

DETAILED DESCRIPTION

In an embodiment of this invention, the apparatus for separating yarns is a two open loop yarns separator guides, one on each end of a main body, this main body having an ergonomic concave curved shape for comfort and performance purpose, that could be made of any chosen material, preferably plastic or resin. This structure is supported by a U-shaped wire curled into an adjustable ring shape mount to fit comfortably on a finger. The main purpose of this invention is to separate different yarns in order to speed and facilitate especially when working on color-work projects in crochet as well as knitting.

The ergonomic concave curved shape—which is one of the novel shapes of the present invention-, on the lower part of one side of the main body fits comfortably on the proximal phalanx (preferred location) of the index finger. Finger choice and position is really up to the user and it may be used on the right or left hand and any of the finger areas from the proximal to the distal end of the finger.

It has a U-shaped malleable material curled into an adjustable ring shape mount preferably enameled copper wire, fixedly attached to two holes made on the bottom of the main body. This ring shape mount can be adjusted to the size of the proximal phalanx (preferred location) of the index finger of the right or left hand. This ring shape, together with the ergonomic concave curved shaped main body, being this shapes part of the novelty of this invention, make the device comfortable to wear, ergonomic to use and it keeps the device standing upright in place, without compromising the fingers circulation or sensitivity.

In this preferred embodiment, it has preferably two (may be three or more) open loop yarns separator guides (around 1 cm internal diameter) able to guide separately one or more strands of fine or chunky yarn. The size of the loop yarns separator guides is an important part of the invention, because they have the capacity to accept multiple yarns in each guide (3) and they have spare room for flow smoothly.

Each open loop yarns separator guide with an (about 0.2 cm) opening preferably in the upper location (4), opening through which the yarn or multiple yarns, can be easily inserted, removed and/or exchanged for use. The open loop yarns separator guides are conveniently separated from each other by the main body (1) (about 2 cm) in order to allow the user to reach each yarn easily and independently—being this ample separation (about 2 cm) one of the most important novelties of the present invention and difference from cited prior art as the main purpose of this invention is to be a yarns separator-.

The main purpose of this device—which is the most important novelty and heart of this invention-, is to keep convenient separation between different yarns in order to be reached individually by the crafter's crochet, during stranded color-work project crafting, without grabbing both yarns at the same time, given the usually ample elliptical crochet movement needed on the crochet crafting technique when grabbing a yarn. The device is especially good for stranded color-work with crochet which movement is normally wider than with needles knitting technique, nevertheless, it can be used with knitting needles as well. This labor and time-saving device may help the user to reach the goal of color-work projects faster and efficiently. It can shorten the time of crocheting and knitting, especially color-work projects which require two or more different color yarns by giving the user more control and easier access to each yarn as needed independently. It addresses the problem of having to drop one yarn color to change to another yarn color and keeping the yarns untangled which may be stressful and a waste of time so the crafter may not lose time untwisting the source yarns. It has also the advantage of freeing the user from being stuck near a surface to hold the yarns in an orderly fashion for color change, given that this device has the capability of separating the yarns efficiently, allowing the user to have the yarns in any desired container and arrangement in any given scenario.

It may also be used as a single yarn guide which may help users who have a disability or difficult time holding the yarn during crocheting and knitting.

Even though the main function of this device is not to be a tensioner by itself, but a yarns separator—which is the novelty and heart of this invention—in order to keep the tension on the yarn, once the yarns are placed in the open loops, those yarns coming out of the back of the device preferably go down from the guide loops between the index finger and middle finger, then up between the middle finger and the ring finger or it can be tensioned as the user prefers. This tension will help to maintain the yarn inside the open loop yarns separator guides.

It is especially for crocheting as well as both Continental or American style Knitting. Right or left handed.

The way to use the ring for crochet is starting the first line in one color in any desired stitch. When it is time to start the pattern, adjust the ring on your index finger and place the desired number of strands of yarn inside each open loop yarns separator guide. Adjust the tension of the yarn with the rest of the fingers as explained before, then reach each color with your crochet as needed for your pattern.

For Continental style knitting, start the first row in one color only, when it is time to start the color pattern, adjust the ring on your index finger and place the yarns inside each open loop yarns separator guide. Adjust the tension of the yarn with the rest of the fingers of that hand as explained before. Start doing the pattern, reaching each color with your needle as needed. A little help with the index and thumb may be necessary to do the work as the yarn is not on the tip of the finger. Another way for this style is to place one yarn in the open loop yarns separator guide closer to the tip of the finger, and use the tip of the same finger for the other yarn, and adjust your tension as you normally would do for knitting. Working that way, the needles are closer for reaching the yarns and make the knitting faster.

For American style knitting, the user would knit the first row in one color to start the pattern, then adjust the ring on the throwing finger, and place the yarns in the open loop yarns separator guides. Adjust the tension of the yarn with the rest of the fingers of that hand as you normally do. Throw the yarn color needed to make each stitch for the pattern as needed, the same way you would do with your finger, but this time helped with guidance of the ring. It will keep your yarn separated and untangled.

In this preferred embodiment, one way to make the device is by making a mold of the body shape with the open loop yarns separator guides, all one piece with plastic injection. The wire (which will be the ring shaped mount) is attached into the body at the same time during the plastic injection molding process. It can be made preferably with two (could be three or more) open loop yarn guides. Another way to make it is by making a digital design of the main body and making it in a 3D printer with a Fused Deposition Modeling (FDM) method, a Stereolithography (SLA), Selective Laser Sintering (SLS), and Fused Filament Fabrication (FFF), which is the preferred way if FDM and SLA methods.

The yarn finger aide guide described above may be modified in many ways. For instance, the open loop yarns separator guides may be provided in any quantity. Further, the openings on each open loop yarns separator guides may be in any other location of the loop beside the upper location, and the position of the loops, their openings, the shape of the loops and the main body may vary according to the quantity of loops designed for manufacture.

The present invention being thus described, it is obvious that the same may be varied in many other ways. Such variations are not to be regarded as departing from the spirit and scope of the invention, and all such modifications as would be obvious to those skilled in the art are intended to be included within the scope of the following claims.

I claim:

1. An apparatus for separating yarns, comprising: a main body, said main body has an ergonomic concave curved shape, said main body has attached an adjustable ring mount to fit on a finger, said adjustable ring mount being a U-shaped wire curled into a ring shape attached securely to a plurality of holes on the bottom side of said main body, said main body is configured to support and space a plurality of open loop yarns separator guides, and said open loop yarns separator guides formed with integral said main body, two said open loop yarns separator guides being the preferred embodiment, said open loop yarns separator guides having enough separation between each other given by said main body in order to allow a user grab one or multiple yarns with a tool, said yarns being of fine or chunky quality, from each said open loop yarns separator guide separately, from one said open loop yarns separator guide at a time, freeing the user from grabbing said yarns from both said open loop yarns separator guides at the same time, in one embodiment said open loop yarns separator guides having an internal diameter portion with enough clearance to hold and allow smoothly flow of plurality of said yarns, said open loop yarns separator guides having an opening on approximately upper side of said open loop yarns separator guide, to allow easy insertion or removal of one or multiple said yarns where by said opening, yarns are stationed for use and kept in place on said internal diameter portion of said open loop yarns separator guides, said open loop yarns separator guides positioned each one on each end of said main body, approximately parallel lengthwise to said main body and to said finger, said one or multiple yarns flowing through each said open loop yarns separator guides approximately parallel to each other, separately from each other by said open loop yarns separator guides separation and approximately perpendicular to said main body and said finger length.

2. An apparatus for separating yarns, comprising: a main body, said main body has an ergonomic concave curved shape, said main body has attached an adjustable ring mount to fit on a finger, said adjustable ring mount being a U-shaped wire curled into a ring shape attached securely to a plurality of holes on the bottom side of said main body, said main body is configured to support and space a plurality of open loop yarns separator guides, and said open loop yarns separator guides formed with integral said main body, two said open loop yarns separator guides being the preferred embodiment, said open loop yarns separator guides having enough separation between each other given by said main body in order to allow a user grab one or multiple yarns with a tool, said yarns being of fine or chunky quality, from each said open loop yarns separator guide separately, from one said open loop yarns separator guide at a time, freeing the user from grabbing said yarns from both said open loop yarns separator guides at the same time, in one embodiment said open loop yarns separator guides having an internal diameter portion with enough clearance to hold and allow smoothly flow of plurality of said yarns, said open loop yarns separator guides having an opening on approximately upper side of said open loop yarns separator guide, to allow easy insertion or removal of one or multiple said yarns where by said opening, yarns are stationed for use and kept in place on said internal diameter portion of said open loop yarns separator guides, said open loop yarns separator guides positioned each one on each end of said main body, approximately parallel lengthwise to said main body and to said finger, said one or multiple yarns flowing through each said open loop yarns separator guides approximately parallel to each other, separately from each other by said open loop yarns separator guides separation and approximately perpendicular to said main body and said finger length.

* * * * *